United States Patent [19]

Foran

[11] Patent Number: 4,830,367

[45] Date of Patent: May 16, 1989

[54] EXERCISE DEVICE

[75] Inventor: William L. Foran, Miami, Fla.

[73] Assignee: Spine Design, Inc., Miami, Fla.

[21] Appl. No.: 123,783

[22] Filed: Nov. 23, 1987

Related U.S. Application Data

[63] Continuation-in-part of Ser. No. 5,615, Jan. 21, 1987, abandoned.

[51] Int. Cl.[4] ..... A63B 21/00

[52] U.S. Cl. ..... 272/145; 272/144

[58] Field of Search ..... 272/144, 145, 134, 143; 128/33, 70

[56] References Cited

U.S. PATENT DOCUMENTS

| | | | |
|---|---|---|---|
| 1,456,317 | 5/1923 | Lauer | 272/145 |
| 2,764,412 | 9/1956 | Dunham | 272/144 |
| 3,119,613 | 1/1964 | Zbyszko | 272/145 |
| 3,178,180 | 4/1965 | Morgan | 272/145 |
| 3,966,200 | 6/1976 | Kirk | 272/145 |
| 4,182,511 | 1/1980 | Camp, Jr. | 272/145 |
| 4,583,731 | 4/1986 | Crivello et al. | 272/144 |

FOREIGN PATENT DOCUMENTS

| | | | |
|---|---|---|---|
| 2562428 | 10/1985 | France | 272/145 |

*Primary Examiner*—Richard J. Apley
*Assistant Examiner*—J. Welsh
*Attorney, Agent, or Firm*—Waters, Morse & Harrington

[57] ABSTRACT

An exercise device having parallel side beams supported horizontally, and also having straps extending between the beams, is provided with auxiliary body-engaging transverse members disposed at a vertical distance from the plane of the side beams. The device also has auxiliary supports for limiting body stress and deflection.

10 Claims, 4 Drawing Sheets

EXERCISE DEVICE

CROSS REFERENCE

This application is a continuation-in-part of application Ser. No. 07/005,615, filed Jan. 21, 1987, now abandoned.

BACKGROUND OF THE INVENTION

A type of exercise device that has come into general use has parallel horizontal beams supported at about hip height, and a group of fabric straps extending between these beams at various positions along their length. In one form of this type of device, one end of the horizontal beams is secured to a wall bracket, and the opposite, or outer ends, are supported by an "H"-shaped leg structure. The cross bar of the leg structure is far enough below the level of the horizontal beams to allow for the presence of various parts of the body of a user of the device as he is supported on the straps. Usually, the leg structure is set back somewhat from the outer ends of the beams so that these extremities can function as handles for certain exercises.

These devices are used in a variety of ways. Typically, the user will sit on the outermost strap, which is positioned near the handles, and will extend his legs in front of him where they will be supported by other straps. If he leans back so that this torso is generally horizontal, and cantilevered beyond his seat support, he may place his ankles or feet underneath one of the other straps to secure his position for performing sit-up exercises. A different set of muscles can be exercised by lying face downward on the straps, with the torso overhanging the outer strap, with the body then being deflected downward and then raised to horizontal position. A variety of leg exercises can also be performed on a device of this type, by the user placing his body closer to the wall-mounted end, so that his body is supported at the shoulders, as well as at the hips. The straps are adjustable along the length of the side beams to provide for a variety of these positions.

These devices are frequently used in physical rehabilitation programs, where injury or illness has seriously limited the range of movement of the body, or its strength with respect to certain muscles. It is often vital that these muscles, and other body structure, be not overstressed or overextended.

The present invention provides additional structure to the basic device described above, which significantly increases the utility by making it suitable for a larger number of exercises.

SUMMARY OF THE INVENTION

Transverse body-engaging means are mounted on the spaced horizontal side beams at positions vertically displaced from the plane of the side beams. One such displaced means is disposed above this plane, and another below it, making additional exercises possible. Both of these body-engaging means are removable to eliminate interference with particular exercises. Structure is provided for limiting the range of movement of certain parts of the body, and to minimize overstressing. A unitary device is thus capable of providing a full exercise program with minimal danger of injury.

DESCRIPTION OF THE PREFERRED EMBODIMENT

Figure 1:
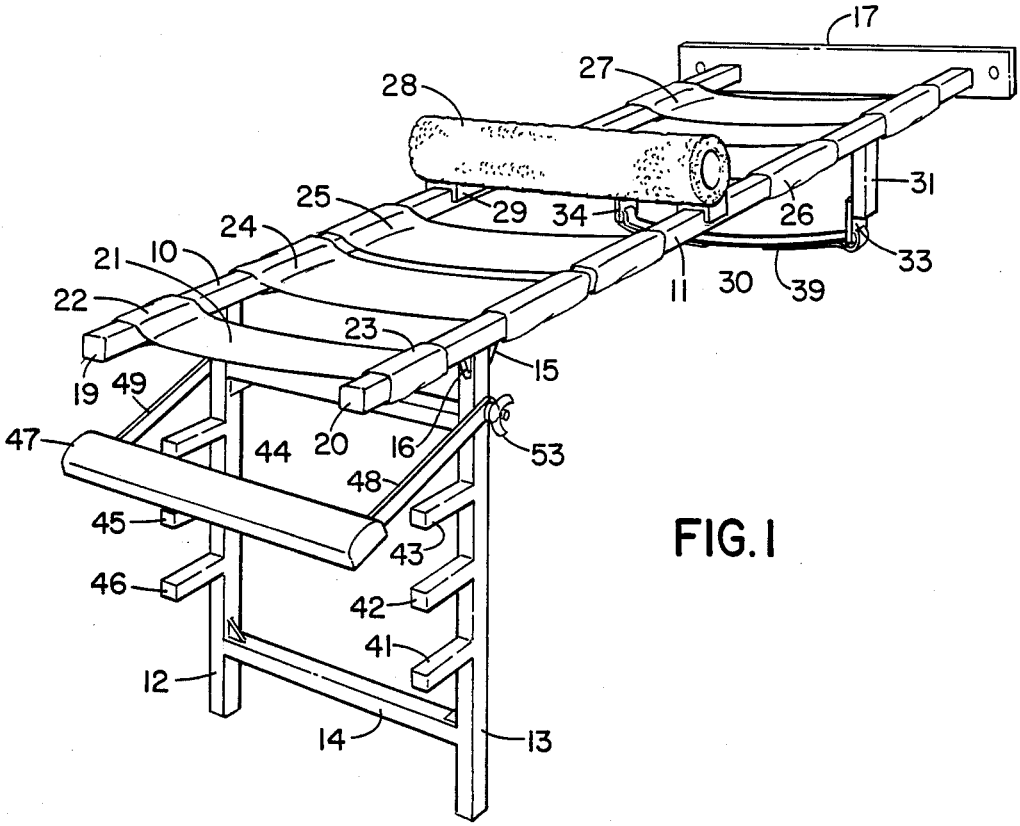
FIG. 1 is a perspective view of the complete exercise device.

Referring to the drawings, the parallel horizontal beams 10 and 11 are supported at about hip height by the "H"-shaped leg structure including the vertical members 12 and 13, and the horizontal member 14. This structure is welded to the side beams 10 and 11 to form a frame, and preferably is reinforced by gussets as shown at 15 and 16. The opposite ends of the beams 10 and 11 are attached in any convenient fashion to the bracket 17 secured to a covenient wall as indicated at 18 in FIG. 2.

The outer ends of the beams 10 and 11 overhang the legs 12 and 13 to form handles indicated at 19 and 20. These are convenient for performing certain exercises, and the placement of the cross member 14 of the leg structure well below the level of the beams 10 and 11 provides adequate space for the performance of these exercises. The fabric strap 21 has end loops 22 and 23 which slip over these handles, so that the strap may be used for supporting portions of the body in some exercises, and removed to provide clearance between the handles 19 and 20 for other exercise movements. The straps 24, 25, 26, and 27 preferably have end loops secured by some convenient form of disengagable fastenings (not shown), and may be slipped along the length of the side beams 10 and 11 to whatever positions may be convenient for the user performing a particular exercise.

Figure 2:
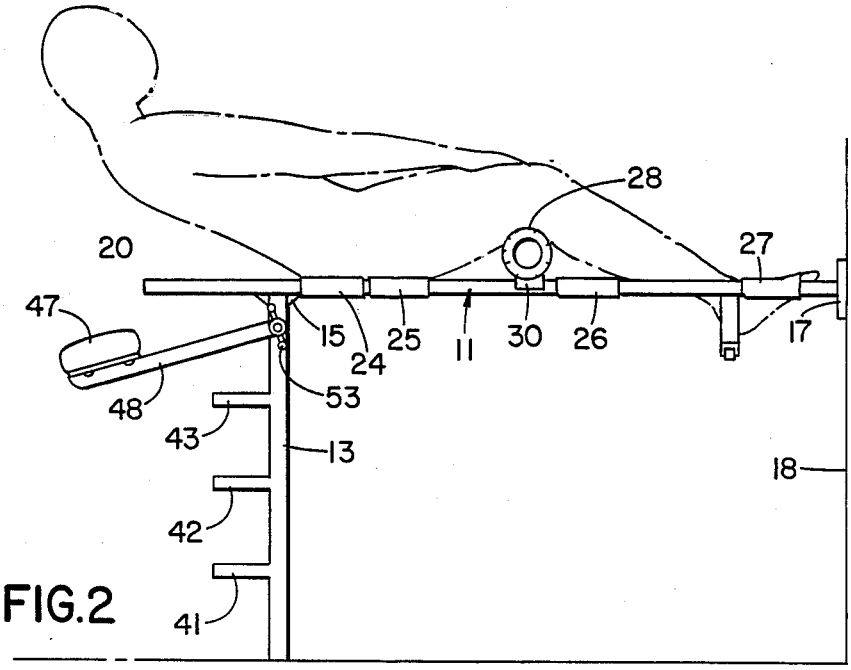
FIG. 2 is a side elevation of the device shown in FIG. 1, with a schematic representation of the body of a user.
Figure 3:
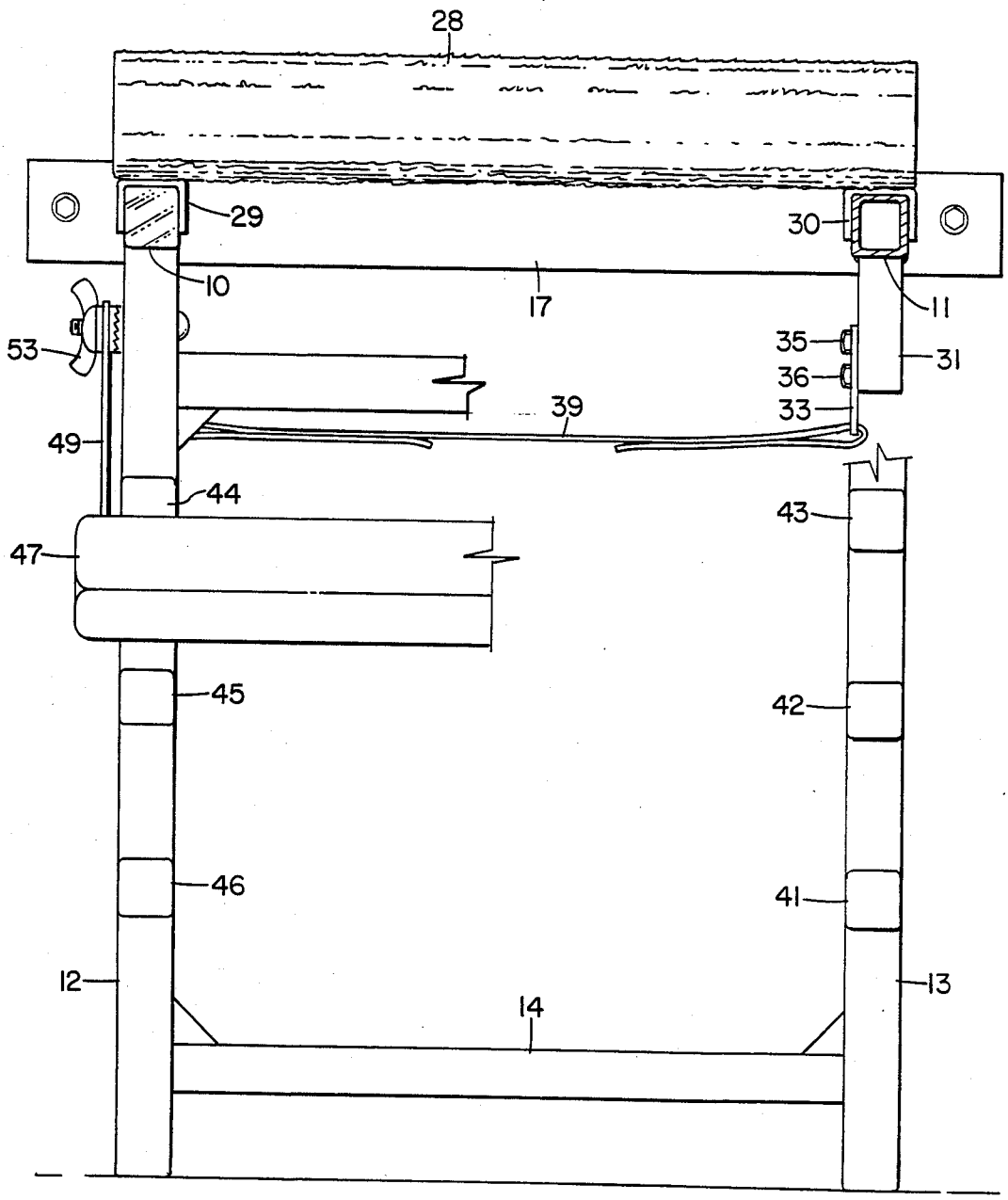
FIG. 3 is a front elevation of the device, on an enlarged scale, partially in section.

It has been well established that the proper position for performing sit-up exercises is with the knees bent. The placement of the knees in the proper position shown in FIG. 2 is assured by the presence of the transverse member 28 disposed above the plane of the beams 10 and 11. This member is in the form of a cylindrical tube, and has the channel-shaped saddles 29 and 30 welded to the member 28 at its opposite ends as shown best in FIG. 3. The saddles fit loosely over the beams 10 and 11, so that the transverse member 28 can be readily removed when it would form an obstruction to other exercises. The loose fit of the saddles 29 and 30 over the beams 10 and 11 also permits the member 28 to be slipped along the beams to whatever position is best for proper engagement with the body of the user underneath the knee joint. The placement of the feet underneath the strap 27 will provide sufficient leverage for the performance of the sit-up exercises, as shown in FIG. 2.

Figure 4:
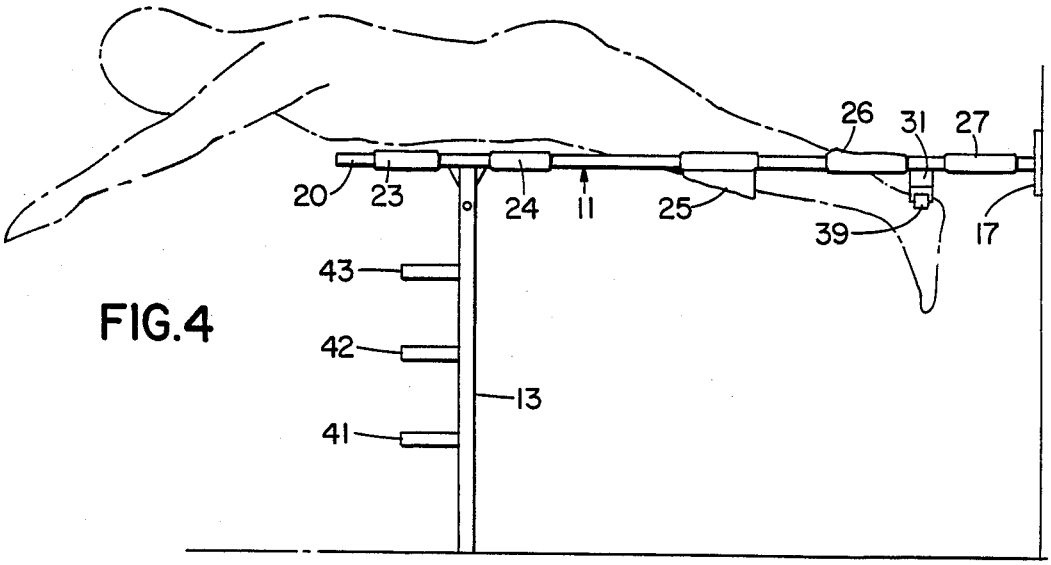
FIG. 4 is a side elevation of the device, with a schematic representation of the body of a user engaging the lower structure. The limiting abutment has been removed in this view.
Figure 5:
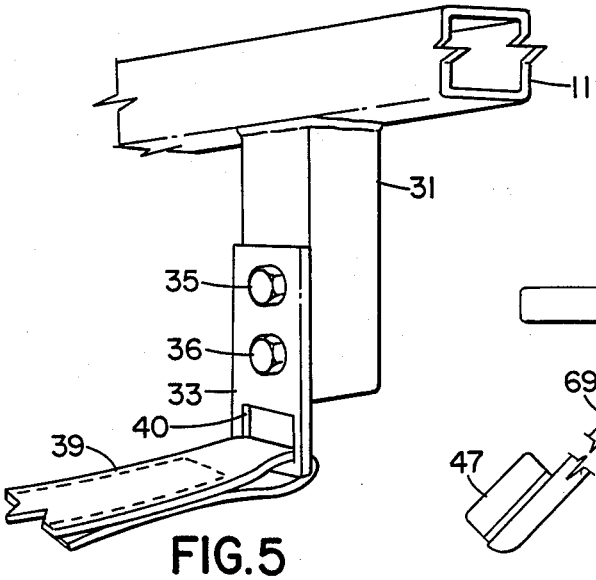
FIG. 5 is a framentary sectional view in perspective showing the details of the lower structure on an enlarged scale.
Figures 6, 7, 8, 9:
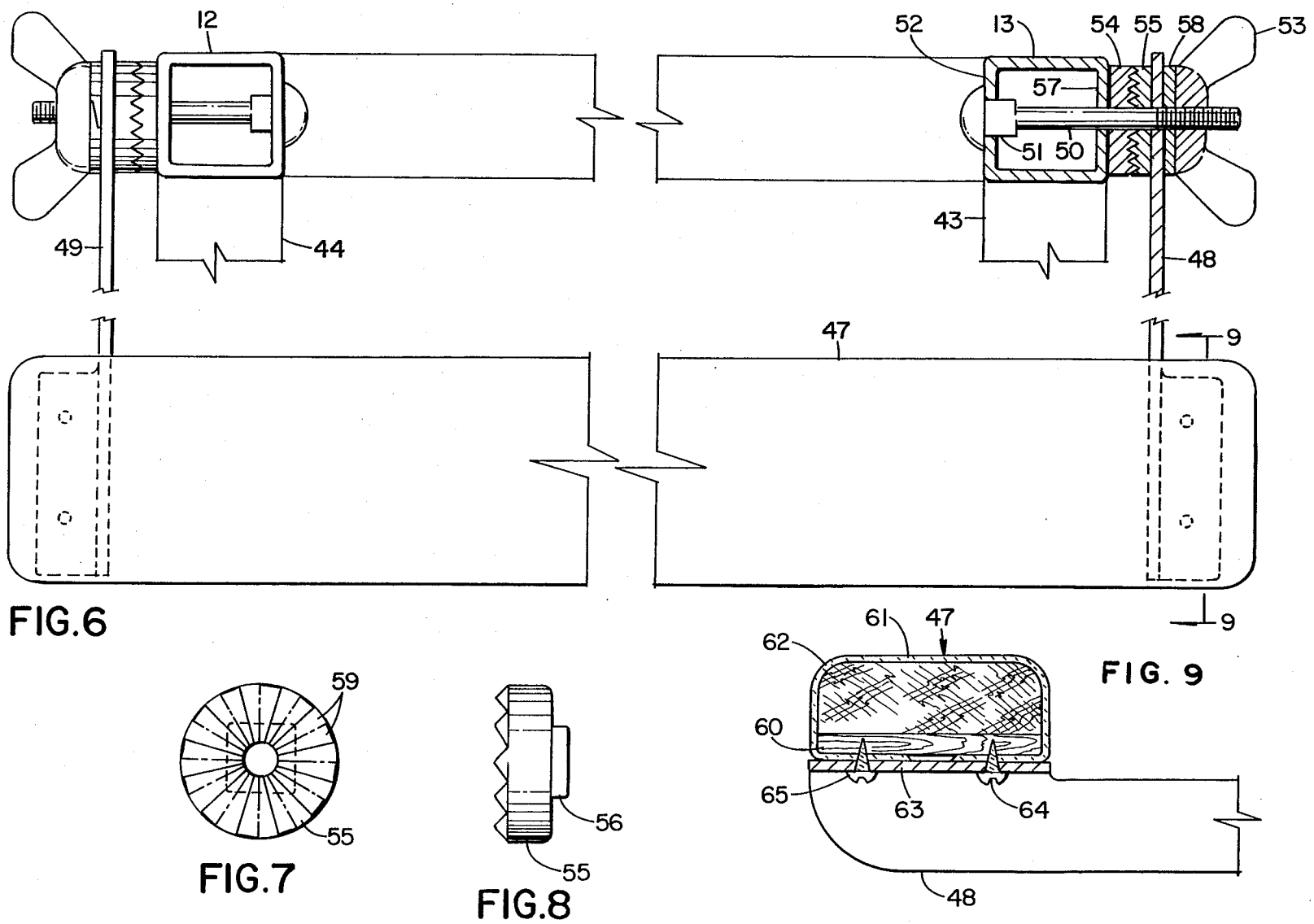
FIG. 6 is a fragmentary sectional view looking down, showing the pivotal attachment of the structure for limiting the downward deflection of the body.
FIG. 7 is a plan view of one of the components that lock the selected angular adjustment of the structure shown in FIG. 6.
FIG. 8 is a side elevation of the components shown in FIG. 7.
FIG. 9 is a section on a plane 9—9 of FIG. 6.

A structure for engaging the body (preferably the heels) of the user at a level below that of the beams 10 and 11 includes opposite depending arms as shown at 31 welded to the beams 10 and 11 preferably about eight inches from the wall, to which the strap terminals 33 and 34 are bolted as shown at 35–36 in FIG. 6. The lower transverse structure is completed by the strap 39, which engages the openings 40 in the brackets. Preferably, strap 39 has at least its end portions provided with VELCRO areas so that the straps can be looped through the openings 40, and then adjusted to whatever degree of tension may be desired. This arrangement also facilitates the complete removal of the straps where they would interfere with other exercises. The presence of this lower structure makes possible the positioning of the body of the user as shown in FIG. 4, where the user's heels engage the underside of strap 39, and his knees engage the top of strap 25. The user starts in a kneeling position and moves his body downwardly toward a position in which the torso extends generally horizontally for an exercise called a "glute-ham" developer, which is an exercise designed to strengthen the gluteus maximus and ham string, and the adjacent back and leg muscle masses. The heel position due to the lower strap provides an improved leg angle for conducting this type of exercise.

When the device is used in a rehabilitation program, careful attention must be given to the prevention of over-extension of muscles and other body structure that may have been subject to disease or injury. The process of exercising must not be permitted to aggravate the original condition. When the lower back muscles are to be exercised with the patient in the position shown in FIG. 4, the strap 21 may be slipped off the ends of the beams 10 and 11 to permit a downward swinging of the torso of the body, followed by a return to the FIG. 4 position. When the group of back muscles involved in this movement is too weak to withstand the forces involved, the patient is free to reach down and grasp any one of the handles 41-46, and use the strength of his arms to move himself back to the FIG. 4 position in the step-by-step sequence of shifting between the vertically-spaced handles. When the patient first begins the exercise, he may be unaware of his inability to restore himself to the FIG. 4 position without assistance, and he can reach for the handles as soon as he finds that his strength capacity is being approached.

A structure for limiting the downward deflection of a cantilevered portion of a patient's body is usable in two different types of exercise. When lying face-down, with the legs overhanging the end of the device, the legs may be swung downward and returned to horizontal in sequence. His ability to return his legs to horizontal alignment may be impaired, and he may be unable to maintain any substantial degree of extension. In a different type of exercise, the patient will be resting on his back on the device, with his torso overhanging the end as shown in FIG. 2, and attempting to deflect his torso downward, followed by a return to a full horizontal cantilever position. Precaution should be taken that the patient not be allowed to position himself so that he is incapable of returning to his original horizontal torso extension. The structure shown in FIGS. 6 through 10 is provided for protection against overstrain in both of these cases. An abutment panel 47 is carried by the radius arms 48 and 49, which are pivotally connected to the frame of the device as shown in FIG. 6. A carriage bolt 50 traverses both side walls of the legs 12 and 13. This type of bolt has an axially short square cross section 51 received in a fairly close fit in a similarly-shaped opening in the side wall 52 of the leg to provide a non-rotative engagement of the bolt to facilitate the adjustment of the wing nut 53. The bolt also traverses the central hole of the peripherally serrated elements shown in FIGS. 7 and 8. The serrations are radial, and the oppositely-facing elements are angularly locked with respect to each other as long as the wing nut 53 has been tightened. This pair of element, shown at 54 and 55 in FIG. 6, each has a squared extension 56. The extension on the element 54 is received in a similarly-shaped hole in the side wall 57 of the leg, and the extension on the element 55 is received in a similarly-shaped hole in the radius arm. The axial length of the extension should be slightly less than the thickness of the radius arm, so that the force of the nut 53 can be brought to bear through the washer 58, and thus stabilize the radius arm. It is preferable that there be some axial resilience to this washer, as is commonly associated with a so-called spring washer. The nut 53 can then be loosened a sufficient amount to permit manual adjustment of the angular position of the radius arms 48 and 49, without musk risk of disengaging the extensions 56 from their squared holes. When the elements 54 and 55 are facing each other, as shown in FIG. 6, the serrations generally indicated at 59 secure the angular position of the arms 48, and thus the position at which the abutment panel 47 will intercept the downward movement of the torso of the patient. The structure of the panel is shown in FIG. 9, and is essentially an example of conventional upholstery. A wooden board 60 forms a backing for the foam padding 61 and the preferably vinyl cover 62. The cover is brought around the edges of the board 60, and tacked in place according to the usual upholstery procedure. A flange 63 is bent from the material of the arm 48, and is provided with suitable holes for receiving wood screws as shown at 64 and 65, which are run into the board 60 to secure the panel with respect to the arms.

Figure 10:
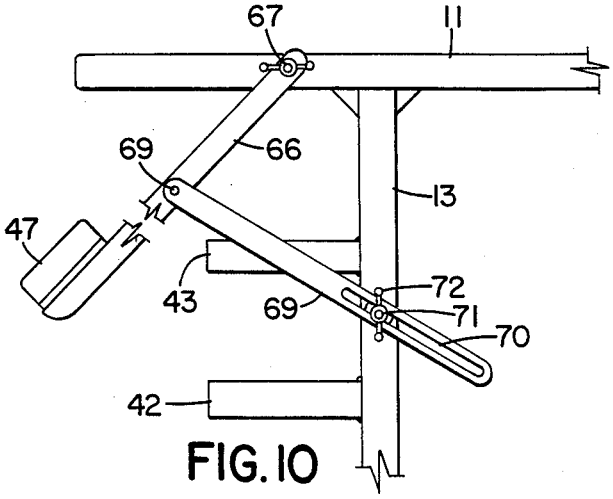
FIG. 10 is a side elevation showing a modification of the invention.

Referring to FIG. 10, a modified arrangement is shown for securing the angular position of the radius arms supporting the abutment panel 47. Here, the arms indicated at 66 are pivotally connected to the beams 10 and 11 on a conventional bolt as shown at 67. The angular position of the arms is controlled by the diagonal braces 68 pivotally connected to the arms as shown at 69. These braces have elongated slots 70 traversed by the bolt 71, and secured by the wing nut 72. The tightening of the nut generates a sufficient degree of friction against the brace 68 to secure the position of the arms 66.

The embodiments of the present invention in which an exclusive property or privelege is claimed are defined as follows:

1. In an exercise device having a frame including spaced substantially horizontal side beams and means supporting the beams in an elevated position and maintaining the spaced relationship of said beams, and also including body supporting strap means extending between and secured to said beams, the device being formed such that a person lays on the straps between the beams for the purpose of doing exercises, wherein the improvement comprises:

heel support means mounted adjacent one end of said beams and extending therebetween at a position below the plane of said beams, the heel support means being engagable to hold the heels of a person at and elevation somewhat below the level of the straps when a person is lying face down on the straps, the straps being positioned or positionable to engage the knees of the person while his heels engage the heel support means so as to hold the lower portion of the person's leg at an inclined angle;

knee-support means removably mountable on said beams disposed to engage the leg of a user adjacent the knees at a position above the plane of said beams;

vertically-spaced handle means mounted on said supporting means and extending parallel to and below said beams at a position below said beams; and a limiting abutment mounted on said frame, and disposed to limit the downward deflection of a portion of the body of a user extending beyond the ends of said beams, the limiting abutment including an engaging panel and adjustable mounting means for mounting the panel at selected positions to provide a desired limitation on body deflection.

2. An exercise device having a frame including spaced substantially horizontal side beams and means supporting and maintaining the spaced relationship of said beams, and also including strap means extending between and secured to said beams, wherein the improvement comprises:

a limiting abutment mounted on said frame, and disposed to limit the downward deflection of a portion of the body of a user extending beyond the ends of said beams, said abutment including a panel and radius arms pivotally connected with respect to said frame respectively, and secured to said panel, and also including means adapted to adjustably secure the angular relationship of said arms and said beams.

3. In an exercise device having a frame including spaced substantially horizontal side beams and means supporting the beams in an elevated position an maintaining the spaced relationship of said beams, and also including body supporting strap means extending between and secured to said beams, the device being formed such that a person lays on the straps between the beams for the purpose of doing exercises, wherein the improvement comprises:

removable knee support means extending across the beams at a position above the beam, the knee support means being positioned longitudinally on the beams at a position where it engages the underside of the person's knees when the person is doing sit ups on the device, one strap being positioned or positionable on one side of the knee support means for engaging the person's feet and restraining them from upward movement, one or more straps being positioned or positionable on the other side of the knee support means for supporting the hips of the user, the knee support means holding the knees at an elevated position relative to the feet and hips of the person such that said means causes the person to perform sit ups with his knees bent.

4. An exercise device according to claim 3 wherein the knee support means comprises a rod that extends transversely between the beams, with a bracket attached to the underside of each end of the rod fitting over each beam and restraining the rod from transverse movement with respect to the beam, the bracket permitting movement of the rod longitudinally along the beams to fit the knees of a particular user.

5. An exercise device according to claim 4 wherein the rod has a curved, padded upper surface that engages the person's knees.

6. In an exercise device having a frame including spaced substantially horizontal side beams and means supporting the beams in an elevated position and maintaining the spaced relationship of said beams, and also including body supporting strap means extending between and secured to said beams, the device being formed such that a person lays on the straps between the beams for the purpose of doing exercises, the means supporting the beams comprising legs attached at least to one end of each beam and extending down to the floor, the improvement wherein the device includes a plurality of handles spaced vertically on the legs, the handles being formed and successively positioned one above the other along the legs in such a manner to constitute a ladder so as to permit a person lying face down on the straps with his torso extending past the end of the frame to raise his torso from a declined position to a level or elevated position with the assistance of his arms by engaging the handles with his hands and pushing up, the engagement of successively higher handles serving to raise the body continually upwardly.

7. An exercise device according to claim 6 wherein the handles comprise a series of vertically spaced projections extending outwardly along each leg.

8. In an exercise device having a frame including spaced substantially horizontal side beams and means supporting the beams in an elevated position and maintaining the spaced relationship of said beams, and also including body supporting strap means extending between and secured to said beams, the device being formed such that a person lays on the straps between the beams for the purpose of doing exercises, wherein the improvement comprises:

heel support means positioned adjacent one end of the frame for engaging and holding a person's heels at a position below the level of the straps when the person is laying face down on the device, the heel support means comprising a resilient heel engaging member extending between support structure positioned below each beam, the person's heels being engageable with the underside of the heel engaging member, the straps being positioned or movable such that the person's knees can be positioned on a strap while his heels are restrained at a lower position under the heel engaging member, thus holding the lower portion of the leg at an upwardly inclined position from the heel to the knee for exercise purposes.

9. An exercise device according to claim 8 wherein the support structure comprises support members that extend downwardly from opposite sides of the beam, and the heel engaging member comprises a flexible strap extending between the support members.

10. An exercise device according to claim 2, 8, 3, or 6 wherein the frame is attached to a wall at one end and is supported on legs at another end, the frame being long enough that a person can support the torso portion or lower portion of his body on the straps with the other portion extending outwardly beyond the end of the frame that is supported on the legs.

* * * * *